US006220956B1

(12) United States Patent
Kilian et al.

(10) Patent No.: US 6,220,956 B1
(45) Date of Patent: Apr. 24, 2001

(54) SOFFIT FAN

(76) Inventors: Jay T. Kilian, 356 Jones Station Rd., Arnold, MD (US) 21012; Gregory L. McConnell, 1109 Poplar Ave., Annapolis, MD (US) 21401

( * ) Notice: Subject to any disclaimer, the term of this patent is extended or adjusted under 35 U.S.C. 154(b) by 0 days.

(21) Appl. No.: 09/503,677

(22) Filed: Feb. 14, 2000

(51) Int. Cl.[7] ..... F24F 11/00
(52) U.S. Cl. ..... 454/239; 454/256; 454/260
(58) Field of Search ..... 454/251, 239, 454/341, 343, 349, 354, 260, 250, 256, 258

(56) References Cited

U.S. PATENT DOCUMENTS

| | | | | |
|---|---|---|---|---|
| 2,770,955 | * | 11/1956 | Lundstrum | 454/260 |
| 3,951,336 | * | 4/1976 | Miller et al. | 454/260 |
| 4,201,121 | | 5/1980 | Brandenburg, Jr. . | |
| 4,550,648 | * | 11/1985 | Eagle | 454/365 |
| 4,667,581 | | 5/1987 | Hovland . | |
| 4,762,053 | | 8/1988 | Wolfert . | |
| 4,776,262 | | 10/1988 | Curran . | |
| 4,986,469 | * | 1/1991 | Sutton, Jr. | 236/49.3 |
| 5,176,316 | * | 1/1993 | Whitman | 234/44 C |
| 5,238,450 | * | 8/1993 | Rotter | 454/260 |
| 5,718,086 | | 2/1998 | Dunn . | |
| 5,728,000 | | 3/1998 | Bateman . | |
| 5,740,636 | | 4/1998 | Archard . | |
| 6,036,102 | * | 3/2000 | Pearson | 236/49.3 |

* cited by examiner

*Primary Examiner*—Harold Joyce
*Assistant Examiner*—Derek S. Boles

(57) ABSTRACT

An apparatus for increasing ventilation of heated and/or moisture-laden air from an attic or roof crawl space (12) in a dwelling or the like, a soffit fan (30) acts to accelerate natural convection by creating an air flow (16) from pulling cooler, denser outside air into attic space (12). The cooler air flow (16) displaces the heated and/or moisture-laden attic air; the attic air rises and is expelled through an opening at or near the top of a roof, preferably through a ridge opening (20) in a roof ridge ventilator (18).

4 Claims, 4 Drawing Sheets

SOFFIT FAN

CROSS-REFERENCE TO RELATED APPLICATIONS

Not Applicable

STATEMENT REGARDING FED SPONSORED R & D

Not Applicable

REFERENCE TO MICROFICHE APPENDIX

Not Applicable

BACKGROUND OF THE INVENTION

This invention relates to attic/roofing ventilation systems, specifically to a forced air system.

Buildings have long incorporated ventilation systems in their attics or roof crawl spaces. Current systems include natural convection systems, a combination of soffit vents, roof vents, gable vents, and ridge vents; forced air systems, a combination of natural convection methods and roof/gable fans; and turbines, a combination of natural convection methods and non-powered turbines. These systems are intended to prevent and remove excessive heat and moisture buildup from attic or roof crawl spaces, or similar spaces. The removal of the excess heat and moisture would lower energy costs for cooling and heating, and would preserve and add longevity to roofing systems.

Current systems are unable to adequately remove the excessive heat trapped in attic spaces. Natural convection systems must wait for attic space air to become heated and expand before cooler air can begin to filter into the attic space. This waiting period, ultimately, is allowing radiant heat to get a jump-start on heating the attic space.

Forced air systems and turbines rely on the suction of less dense air and are, therefore, inefficient. This inefficiency is similar to the flight limitations of a helicopter. Helicopters are limited by altitude because air becomes less dense at higher altitudes. A helicopter reaches maximum altitude when the motion of the blades through the less dense air cannot generate enough lift to compensate for the weight of the aircraft. Thus, air density directly relates to the efficiency of the blades of a helicopter or a fan.

As a result of current systems' inadequacies, there is a need for a more efficient and effective ventilation system that will help to provide more comfortable living, to lower energy costs for cooling and heating, and to preserve and add longevity to roof and shingle lives.

BRIEF SUMMARY OF THE INVENTION

The present invention provides an apparatus for use in ventilating an attic or roof crawl space, or similar space, which becomes a heat and/or moisture trap. The invention increases air flow in the attic space, and therefore improves ventilation and provides many advantages.

Accordingly, several objects and advantages of the invention are:

(a) to provide an apparatus that will help to lower energy costs for cooling and heating;

(b) to provide an apparatus that will add longevity to roofing systems;

(c) to provide an apparatus that will accelerate natural convection venting of heated, trapped air from an attic space;

(d) to provide an apparatus that will reduce heat loading within a building;

(e) to provide an apparatus that will control moisture due to humidity within an attic space;

(f) to provide an apparatus that will reduce moisture due to condensation within an attic space;

(g) to provide an apparatus that can be installed on new construction or onto existing buildings; and (h) to provide an unobtrusive, inconspicuous ventilation apparatus.

Further objects and advantages are to provide an apparatus whose production requires minimal new tooling resulting in its relatively inexpensive manufacture. Still further objects and advantages will become apparent from a consideration of the ensuing description and drawings.

REFERENCE NUMERALS IN DRAWINGS

| | |
|---|---|
| 10 conventional roof | 12 attic or roof crawl space |
| 14 building | 16 air flow |
| 18 roof ridge ventilator | 20 ridge opening |
| 22 ceiling | 26 soffit |
| 28 screen | 30 soffit fan |
| 32 soffit vent | 34 temperature/moisture switch |
| 36 louver | 38 fan guard |
| 40 mounting bracket assembly | 42 mounting screw |
| 44 fan | 46 electrical cord |
| 48 louver stopper | |

DETAILED DESCRIPTION OF THE INVENTION

Figure 1:
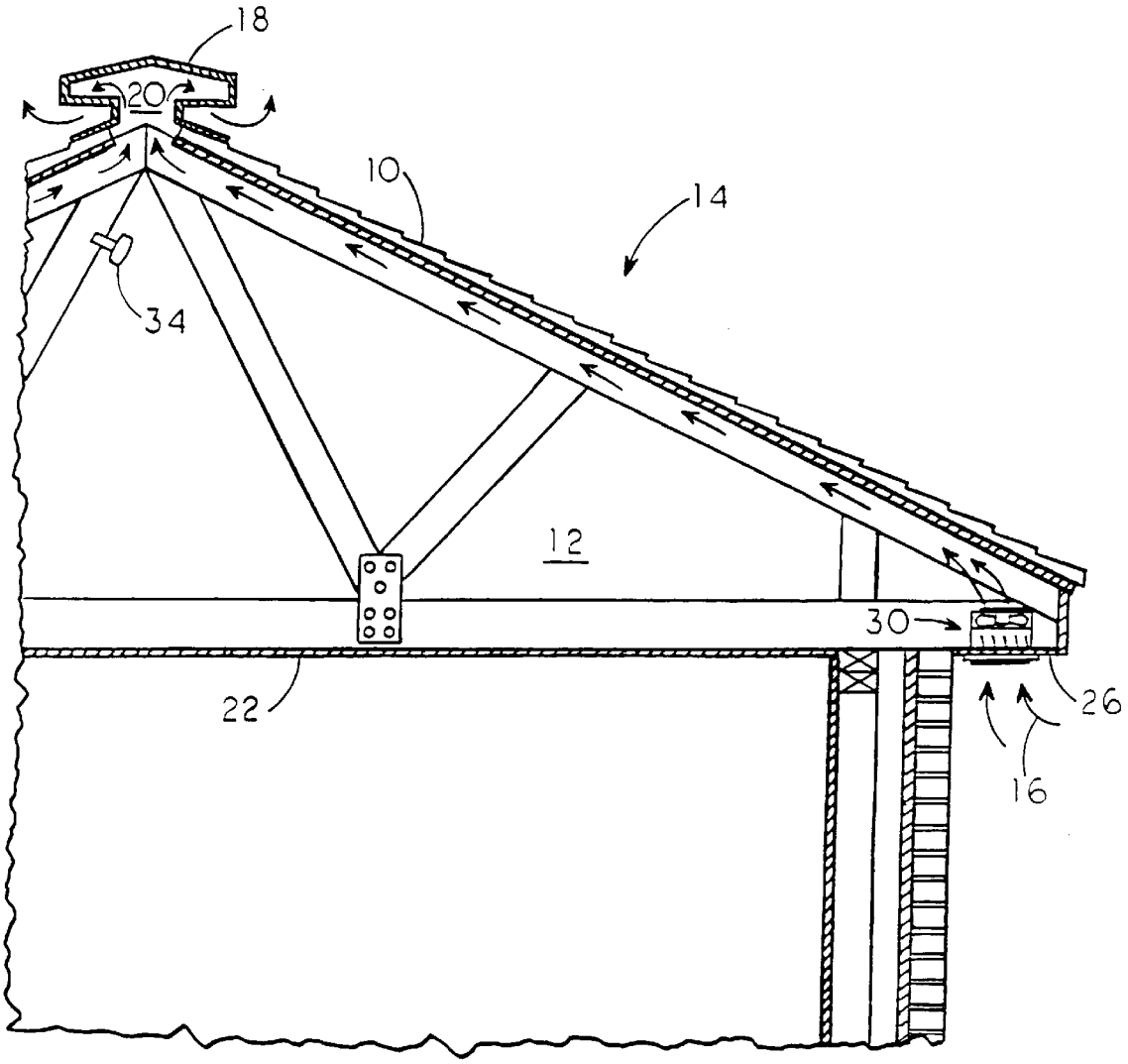
FIG. 1 is a perspective view of the invention shown in an elevation view in section of the upper portion or attic space of a building such as a house.

As shown in FIG. 1, a building 14 is comprised of a conventional roof 10 that surmounts and partially encloses a space typically referred to as an attic or roof crawl space 12. Attic 12 is further bound and defined by upper surface portions of a ceiling 22. A ridge opening 20 is located at the top of roof 10 in a roof ridge ventilator 18. A temperature/moisture switch 34 is mounted in the upper portion of attic 12. A soffit fan 30 is located in a soffit 26 under the eaves of roof 10.

Figure 2:
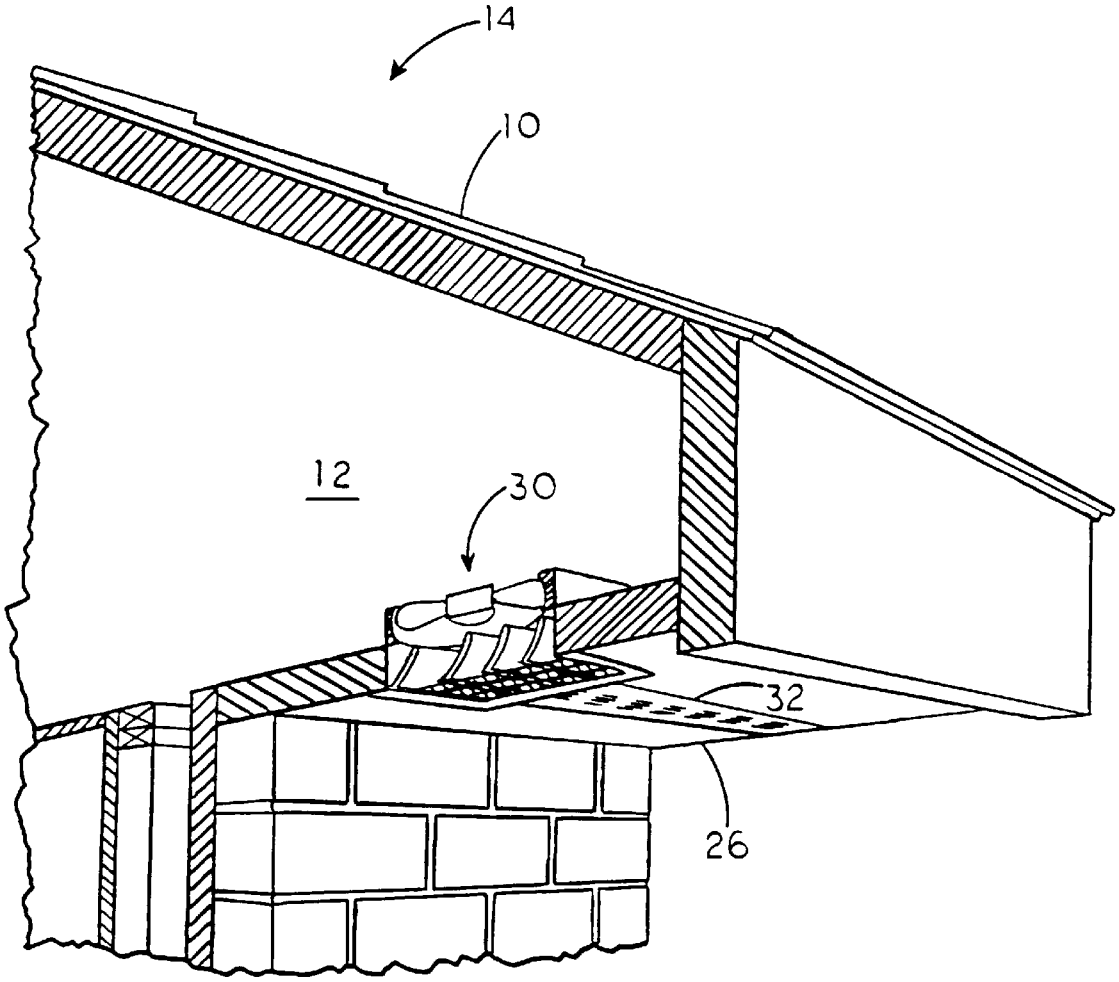
FIG. 2 is a perspective view of the invention mounted in a soffit.

FIG. 2 shows a closer look at the placement of soffit fan 30 in building 14. Typical placement of soffit fan 30 is under the eave of roof 10, between the end of the eave and the wall, in the center of soffit 26 and along the same line as a soffit vent 32. The top of soffit fan 30 is in attic 12.

Figure 3A:
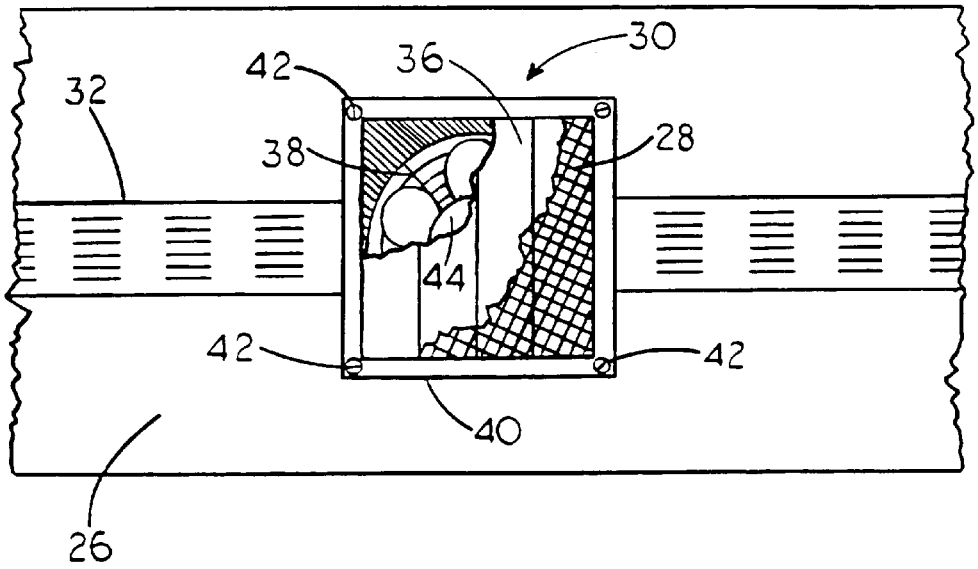
FIG. 3A is a view in section from the ground up of the major components of the invention mounted in a soffit when the invention is not in operation.
Figure 3B:
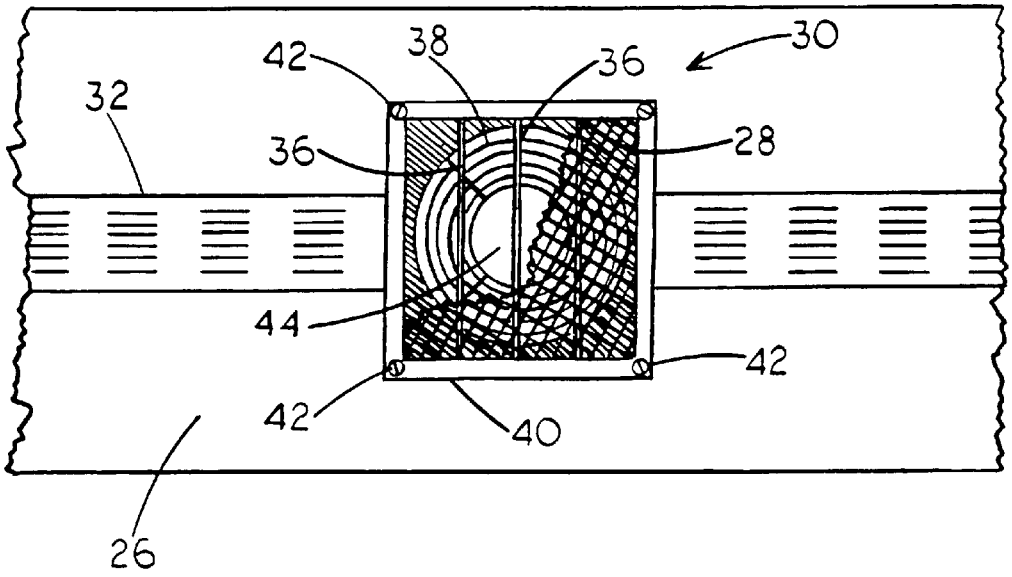
FIG. 3B is a view in section from the ground up of the major components of the invention mounted in a soffit when the invention is in operation.

FIGS. 3A and 3B show the appearance of the major components of soffit fan 30 installed in soffit 26 along the same line as soffit vent 32. Both Figs show a mounting bracket assembly 40 that is used to attach soffit fan 30 to soffit 26 using mounting screws 42. Both Figs also show a fan guard 38, a fan 44, a set of louvers 36, and a screen 28. The difference between FIGS. 3A and 3B is that FIG. 3A depicts soffit fan 30 while not operating and FIG. 3B depicts soffit fan 30 while operating. Note in FIG. 3A that fan 44 is motionless and louvers 36 are closed whereas in FIG. 3B, the blades of fan 44 are not seen as a result of their motion, thus giving the illusion of translucence and louvers 36 are open.

Figure 4:
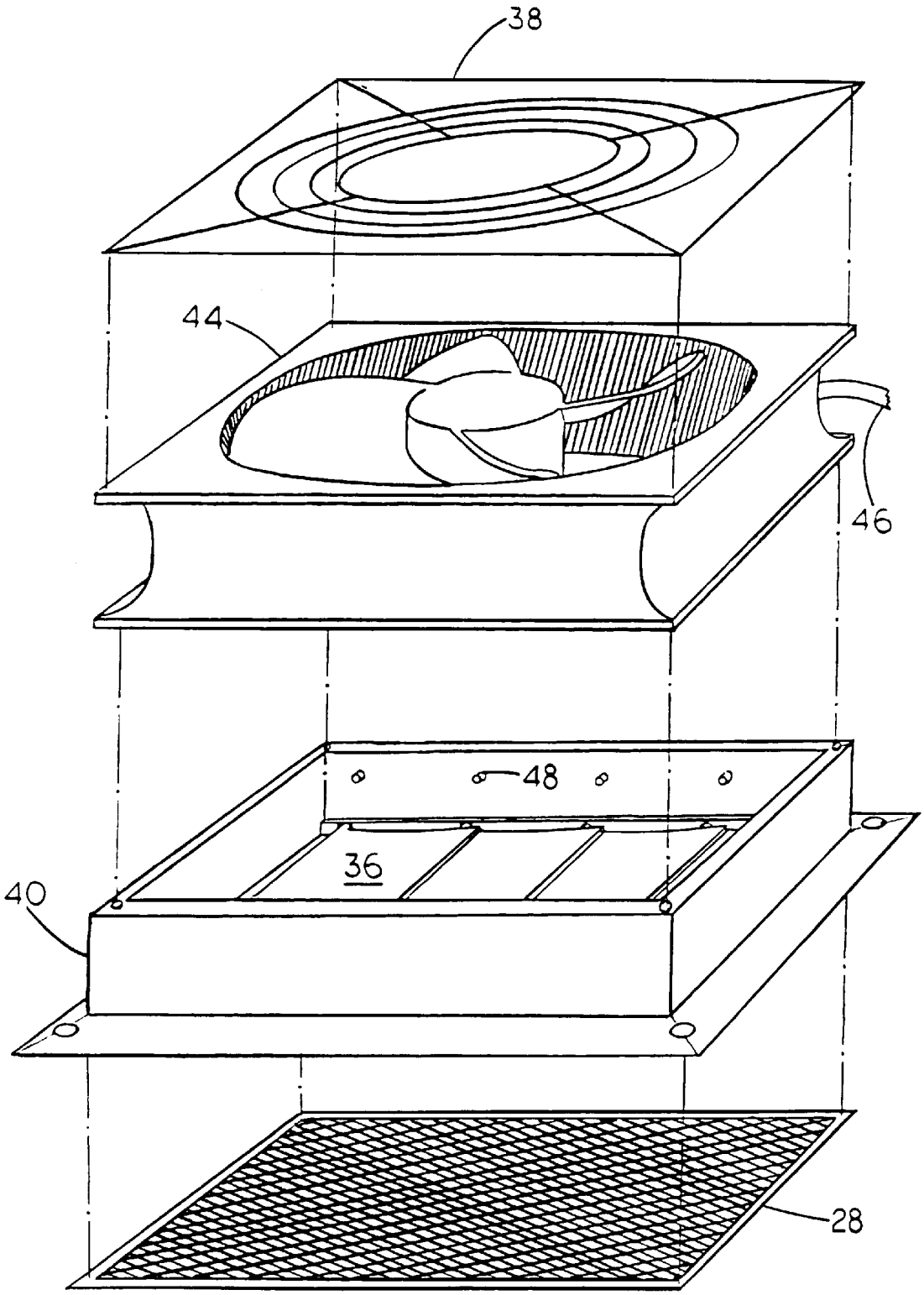
FIG. 4 is an exploded detailed view of the invention.

FIG. 4 shows a breakdown of soffit fan 30. From top to bottom, soffit fan 30 is described as follows. Fan guard 38 is attached to fan 44. An electrical cord 46 is attached to fan 44 to provide power. Fan 44 is connected to mounting assembly 40. Louvers 36 are attached to mounting assembly 40. Louvers 36 are fully open once they come in contact with and are stopped by a louver stopper 48. Finally, screen 28 covers mounting assembly 40.

Operation of soffit fan 30 will now be explained.

Referring to FIG. 1, when temperatures rise and solar heat is incident on roof 10, typically the result is a substantial increase in thermal loading in attic 12 and a radiant heat trap. The trapped attic air expands as it is heated. In order to vent this undesirable trapped heat in attic 12, switch 34 signals soffit fan 30 to begin operating. Alternatively, a sensed moisture difference between ambient air and the air located in attic 12 could trigger switch 34 to signal soffit fan 30 to begin operating.

When fan 44 begins operating, the suction of an air flow 16 causes louvers 36 to open until they come in contact with a louver stopper 48, as shown in FIG. 4. Air flow 16 enters into attic 12.

Referring to FIG. 4, fan guard 38 protects fan 44 from debris and insulation in attic 12. Screen 28 covers soffit fan 30 on the outside to aid in preventing insect infestation, bird nesting, and other foreign object damage or intrusion. Louvers 36 are used to aid in preventing foreign object intrusion and to provide an unobtrusive, inconspicuous appearance. A view from the ground up at the major components of soffit fan 30 while it is operating is shown in FIG. 3B. Note that louvers 36 are open and that the blades of fan 44 are not seen as a result of their motion giving the illusion of translucence.

Referring to FIG. 1, air flow 16 is being pulled by soffit fan 30 into attic 12. Air is also entering attic 12 through soffit vents 32. As this cooler air flow 16 enters attic 12, it displaces the heated and/or moisture-laden air. The displaced air rises and is expelled through ridge opening 20 in roof ridge ventilator 18. Because soffit fan 30 significantly increases cooler air flow 16 into attic 12, this process accelerates natural convection.

Accelerated natural convection continues until attic 12 temperature and/or moisture decreases and switch 34 signals soffit fan 30 to cease operating. Once fan 44 stops, soffit fan 30 returns to its dormant state with louvers 36 closed due to gravity, as shown in FIG. 3A.

Conclusion, Ramifications, and Scope

Accordingly, the reader will see that the soffit fan of this invention provides efficient accelerated natural convection ventilation in attic or roof crawl spaces. In addition, the soffit fan has additional advantages in that:

it helps lower energy costs related to cooling and heating it helps prolong and preserve roof and shingle lives it helps reduce heat loading in buildings it helps reduce moisture in attic or roof crawl spaces it is an unobtrusive, inconspicuous ventilation apparatus Although the description above contains many specificities, these should not be construed as limiting the scope of the invention but as merely providing illustrations of some of the presently preferred embodiments of the invention. Many other variations are possible. For example, the soffit fan is not limited by shape, it can have other shapes such as square, circular, oval, etc.; the screen cover is optional; the louvered system may be substituted, altered, or omitted; fasteners may be substituted or altered; power may come from an alternate source; the fan type, classification, specifications, and parameters are not limited; etc.

Thus the scope of the invention should be determined not by the examples given, but by the appended claims and their legal equivalents.

We claim:

1. An accelerated-natural convection, forced-air, ventilation apparatus for the prevention of excessive heat and/or moisture buildup in an attic or roof crawl space, comprising:

a. a fan mounted within a soffit that takes suction directly from cooler, denser, ambient air located below said soffit;

b. a temperature switch located within said attic or roof crawl space that manipulates said fan;

c. louvered baffles that are manipulated open by said suction of said fan and manipulated closed by gravity when said fan is not in operation;

d. a guard that protects said fan from foreign object damage from within said attic or roof crawl space;

e. a screen that protects said fan and said attic or roof crawl space from insect/animal infestation;

f. a moisture switch located within said attic or roof crawl space that manipulates said fan.

2. An apparatus according to claim 1 further comprising:

a. a fire sensor for said ventilation apparatus shut-down.

3. A fan mounted within a soffit, accelerated-natural convection, ventilation method for the prevention of excessive heat buildup in an attic or roof crawl space, comprising the steps of:

a. detecting an excessive heat buildup in said attic or roof crawl space;

b. ventilating an air space located within said attic or roof crawl space;

c. taking suction from a cooler, denser ambient air located below said soffit;

d. discharging said cooler, denser ambient air into said attic or roof crawl space;

e. displacing a less dense, hotter attic or roof crawl space air;

f. discharging said hotter air through a roof opening(s) located at or near the top of said roof.

4. A fan mounted within a soffit, ventilation method for the prevention of excessive moisture buildup in an attic or roof crawl space, comprising the steps of:

a. detecting an excessive moisture content in an air space located in said attic or roof crawl space;

b. ventilating said air space;

c. taking suction from a drier ambient air located below said soffit;

d. discharging said drier ambient air into said attic or roof crawl space;

e. displacing and amalgamating said drier ambient air with a moisture-laden attic or roof crawl space air;

f. discharging said amalgamated air through a roof opening(s).

* * * * *